US011701572B1

(12) United States Patent
Zheng et al.

(10) Patent No.: US 11,701,572 B1
(45) Date of Patent: Jul. 18, 2023

(54) SNOW BASKET QUICK-RELEASE SYSTEM FOR A SKI POLE

(71) Applicant: Zhouyang Zheng, Xiamen (CN)

(72) Inventors: Zhouyang Zheng, Xiamen (CN); Yuqiu Huang, Xiamen (CN)

(73) Assignee: Zhouyang Zheng, Xiamen (CN)

( * ) Notice: Subject to any disclaimer, the term of this patent is extended or adjusted under 35 U.S.C. 154(b) by 0 days.

(21) Appl. No.: 17/992,979

(22) Filed: Nov. 23, 2022

(30) Foreign Application Priority Data

Oct. 28, 2022 (CN) ..... 202222876170.9

(51) Int. Cl.
*A63C 11/24* (2006.01)
*A63C 11/22* (2006.01)

(52) U.S. Cl.
CPC ..... *A63C 11/227* (2013.01)

(58) Field of Classification Search
CPC ..... A63C 11/22; A63C 11/24; A63C 11/227; A45B 9/04
See application file for complete search history.

(56) References Cited

U.S. PATENT DOCUMENTS 4,385,776 A * 5/1983 Pronzati ..... A63C 11/22 280/824
6,203,064 B1 * 3/2001 Zaltron ..... A63C 11/24 403/349
6,390,109 B1 * 5/2002 Manninen ..... A63C 11/24 135/65
10,166,458 B1 * 1/2019 Khamitov ..... A63C 11/24
2011/0018250 A1 * 1/2011 Lenhart ..... A45B 9/04 280/824
2013/0328297 A1 * 12/2013 Lenhart ..... A63C 11/24 280/824
2014/0209134 A1 * 7/2014 Donnadieu ..... A63C 11/24 135/77
2018/0177268 A1 * 6/2018 D'Jay ..... A45B 9/02

* cited by examiner

*Primary Examiner* — Brian L Swenson

(57) ABSTRACT

A ski pole including a sleeve and a snow basket, wherein the upper end of the sleeve is provided with a hook, the snow basket is provided with a sleeve mounting groove, the upper end of the sleeve mounting groove is provided with an engagement groove and a press section, the diameter of the press section is slightly larger than the diameter of the sleeve, the press section drives the engagement groove to deform elastically, the sleeve is installed on the snow basket by inserting the sleeve mounting groove, and the hook is engaged on the engagement groove. The present invention has the following advantageous effects: the installation and disassembly of snow bracket and sleeve do not require professional tools to operate, a user can complete the disassembly and installation of snow bracket with their bare hands, the installation is convenient and quick and it saves time and costs.

4 Claims, 8 Drawing Sheets

SNOW BASKET QUICK-RELEASE SYSTEM FOR A SKI POLE

TECHNICAL FIELD OF THE INVENTION

The present invention relates to the technical field of ski pole parts, especially a snow basket quick-release system for a ski pole.

BACKGROUND OF THE INVENTION

A snow basket is the most important part of a ski pole. When walking on the snow, it can effectively avoid the ski pole's tip inserted too deep to cause danger. However, the incorrect use of the ski pole will often cause damage to the snow basket. In order to facilitate the replacement of the snow basket, it is usually designed to be releasable. At present, most of the fixing manners of snow bracket on the market are threaded screwing with the sleeve, fixed with clamps or locked with bolts. The manner of threaded screwing makes the snow basket easy to loosen, the manner of fixing with clamps makes the snow basket easy to rotate, thus causing the use unsmooth, while the manner of locking with bolts need to punch holes in the sleeve, resulting in inconvenient processing and more difficult disassembly, while requiring the use of professional tools, a user cannot easily replace the snow basket, as well as the time-consuming of the replacement of the snow basket is not user-friendly.

SUMMARY OF THE INVENTION

An object of the present invention is to provide a snow basket quick-release system for a ski pole. The installation and disassembly of snow bracket and sleeve do not require professional tools to operate, a user can complete the disassembly and installation of snow bracket with their bare hands, the installation is convenient and quick and saves time and costs.

In order to realize the purpose of the present invention, the present invention provides the following technical solutions:

A snow basket quick-release system for a ski pole, including a sleeve and a snow basket, wherein the upper end of the sleeve is provided with a hook, the snow basket is provided with a sleeve mounting groove, the upper end of the sleeve mounting groove is provided with an engagement groove and a press section, the diameter of the press section is slightly larger than the diameter of the sleeve, the press section drives the engagement groove to deform elastically, the sleeve is installed on the snow basket by inserting the sleeve mounting groove, and the hook is engaged on the engagement groove.

Preferably, the lower portion of the press section is provided with a L-shaped hollowed-out area. The L-shaped hollowed-out area separates the press section from the sleeve mounting groove. When the user presses the press section by hand, the elastic deformation of the press section will not affect the sleeve mounting groove, and the magnitude of pressing force only needs to be controlled to drive the press section, which can save the user's pressing force and facilitate the use.

Preferably, the upper portion of the sleeve is provided with a sleeve flange, and the lower portion of the L-shaped hollowed-out area is provided with a snow basket flange. The sleeve flange and the snow basket flange can protect the press section to avoid its abnormal releasing when impacted by foreign objects, thus causing the sleeve to be abnormally decoupled.

Preferably, the bottom of the sleeve mounting groove is provided with an anti-rotation groove, the bottom of the sleeve is provided with a polygonal position limiting block, the shape of the polygonal position limiting block corresponds to the anti-rotation groove, and the polygonal position limiting block is inserted in the anti-rotation groove to prevent the relative rotation of the snow basket and the sleeve when the ski pole is used after the sleeve is inserted into the sleeve mounting groove, thus causing the problem of abnormal decoupling of the hook from the engagement groove, so as to increase the assembly stability of the sleeve and the snow basket.

Preferably, the top of the sleeve is provided with an inserting column arranged along the vertical direction, the press section is provided with an, inserting hole corresponding to the inserting column, and the inserting column inserted into the inserting hole and fixed when the sleeve is inserted into the snow basket. The inserting hole allows the inserting column to move in the vertical direction and restricts the inserting column to move in other directions to prevent the press section from offsetting to the left or right in the direction of pressing force and causing the hook to be decoupled.

Preferably, the bottom of the snow basket is provided with a tungsten steel pole tip. Tungsten steel has the advantages of high hardness and wear resistance, which can prolong the damage time of pole tip and prolong the period of replacing the snow basket for easy use.

Compared with the prior art, the present invention has the following advantageous effects:

The present invention is provided with a sleeve and a snow basket, wherein the sleeve is used to connect and fix the ski pole, and the pole tip is mounted on the snow basket. The ski pole and the pole tip are assembled through the sleeve and the snow basket to be used as ski pole, wherein the upper end of the sleeve is provided with a hook, the snow basket is provided with a sleeve mounting groove corresponding to the size of the sleeve, the upper end of the sleeve mounting groove is provided with an engagement groove and a press section, the diameter of the press section is slightly larger than the diameter of the sleeve, thereby allowing a certain amount of press space for the press section, and the hook is aligned with the position of the engagement groove when the sleeve is ready to be inserted into the sleeve mounting groove. The sleeve begins to be inserted into the sleeve mounting groove, the hook presses the press section on the sleeve mounting groove, and the press section undergoes elastic deformation to accommodate the hook into the sleeve mounting groove. The sleeve continues to be inserted into the sleeve mounting groove, the hook continues to penetrate deeper until it reaches the position of the engagement groove, the hook is completely immersed in the engagement groove, the hook no longer presses the press section, the press section springs back, the snow basket returns to the undeformed state, thus completing the installation of the sleeve and the snow basket. When replacing the snow bracket, the press section on the sleeve mounting groove needs to be pressed, the press section is pressed to drive the engagement groove to elastically deform, the engagement groove is detached from the hook, and the user can directly remove the sleeve from the snow bracket, thus enabling the disassembly of the snow bracket. The installation and disassembly of the snow bracket and the sleeve do not require the use of threads or bolts for locking, and can be operated by hands, the disassembly and installation are simple and quick, and the consumed time and cost are low.

Therefore, the present invention provides with a snow basket quick-release system for a ski pole. The installation and disassembly of snow bracket and sleeve do not require professional tools to operate, a user can complete the disassembly and installation of snow bracket with their bare hands, the installation is convenient and quick and saves time and costs.

DETAILED DESCRIPTION OF THE INVENTION

Figure 1:
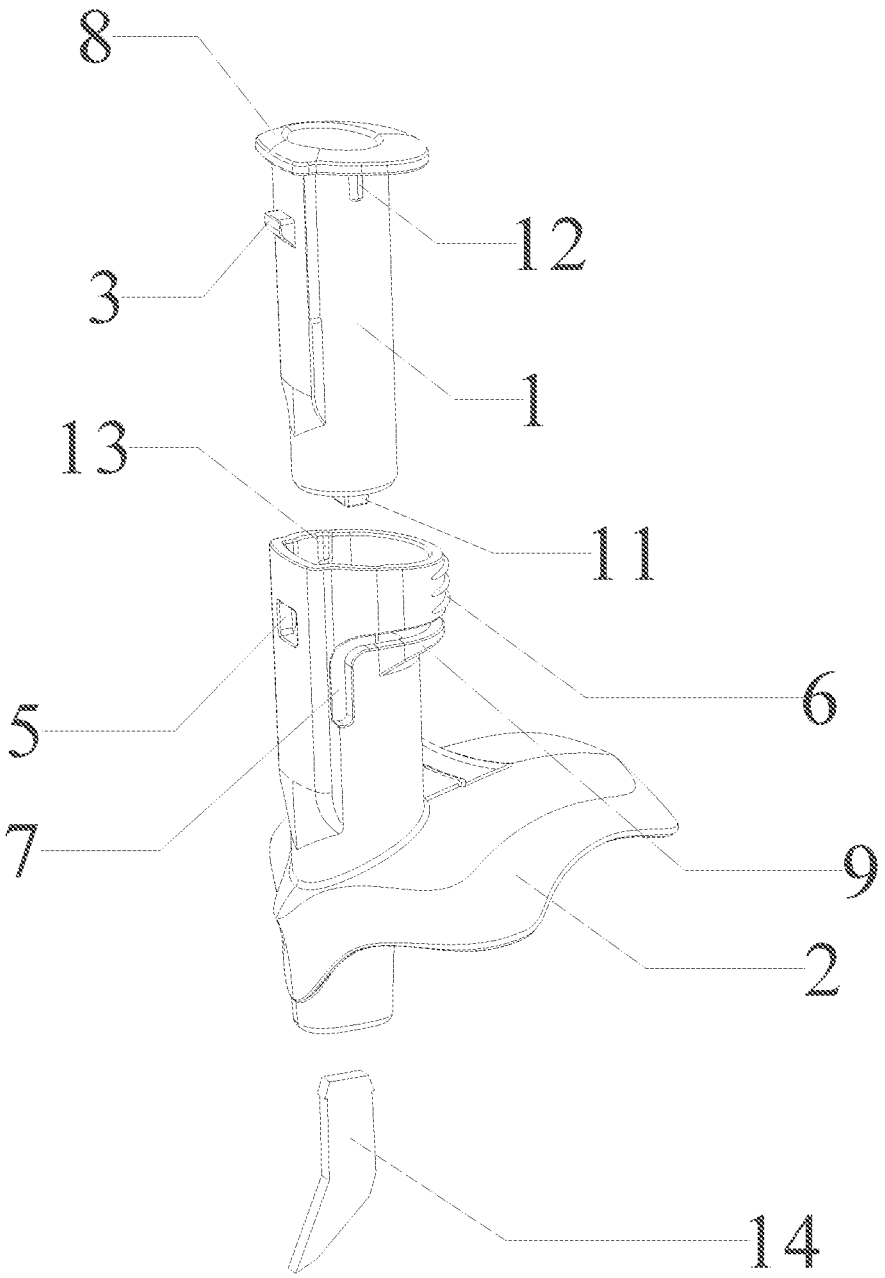
FIG. 1 is a schematic view of the split structure of the present invention.
Figure 2:
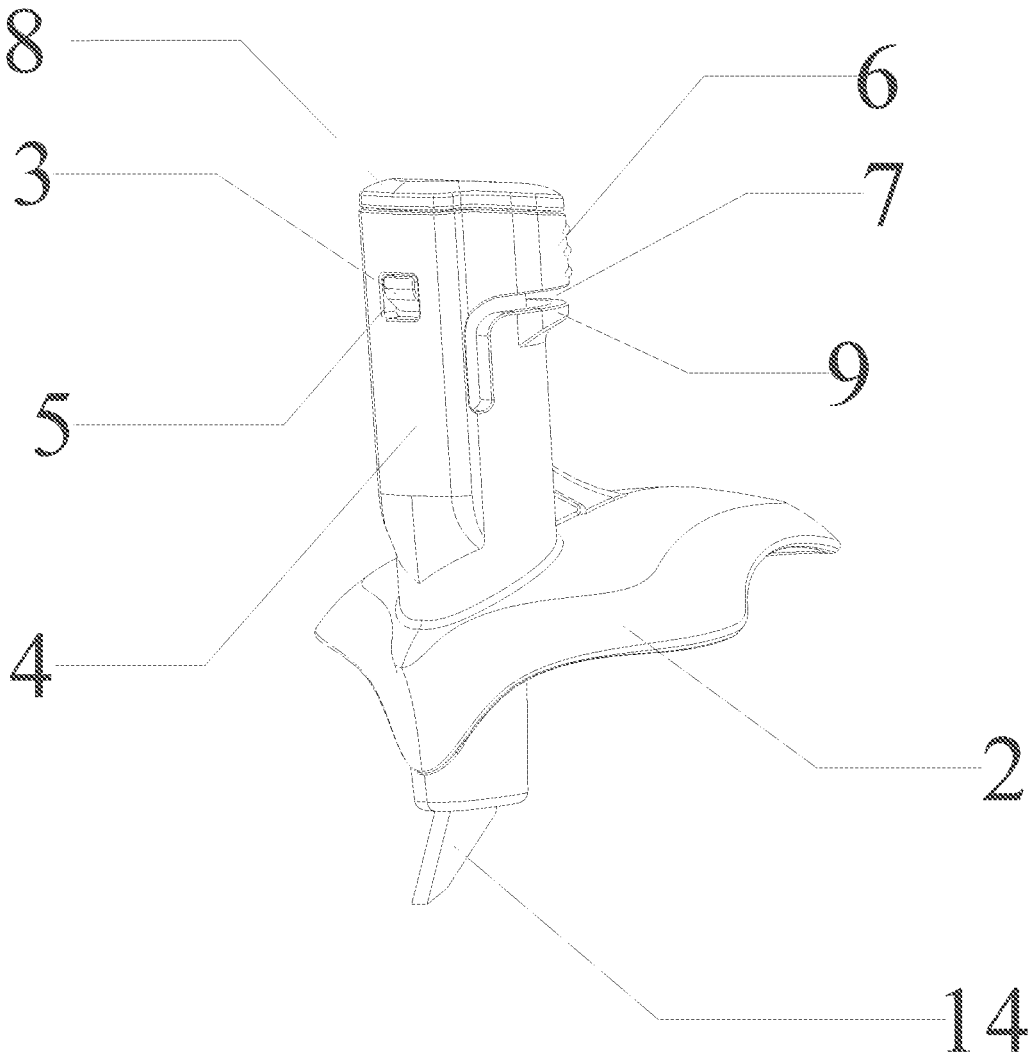
FIG. 2 is a schematic view of the overall structure of the present invention.
Figure 3:
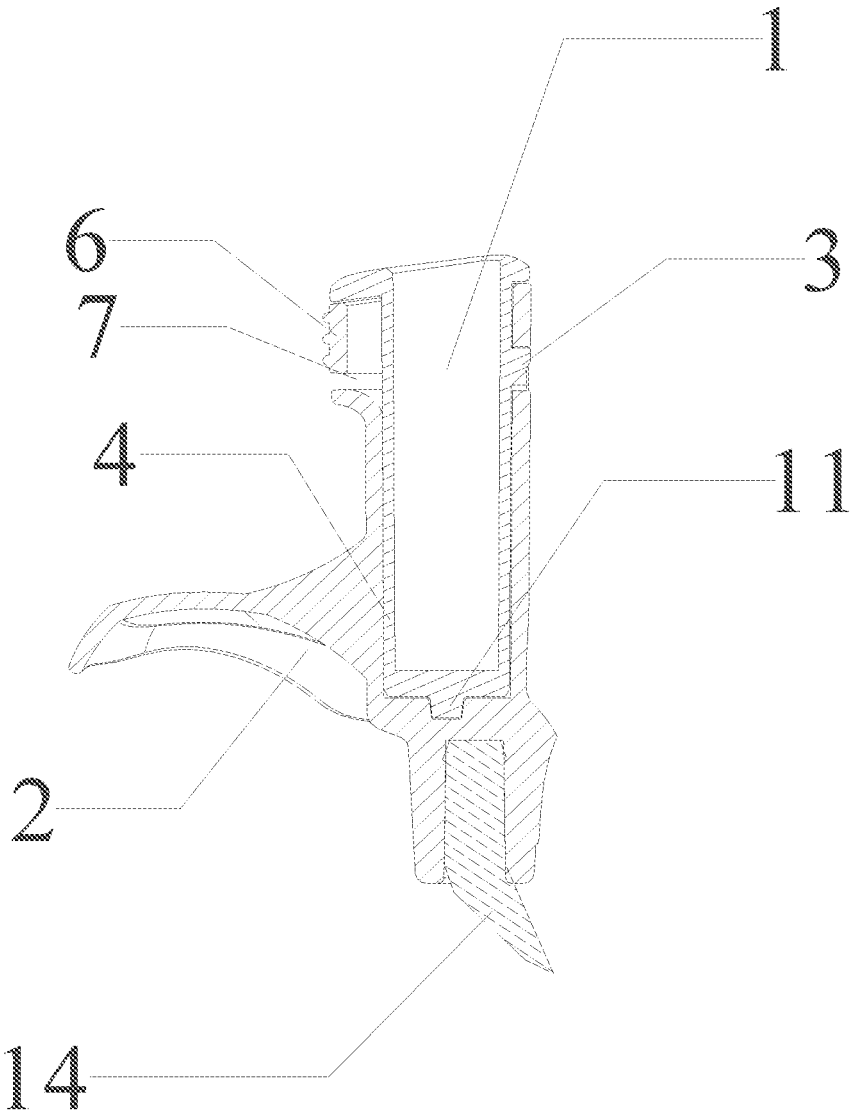
FIG. 3 is a cross-sectional view of the structure of the present invention.
Figure 4:
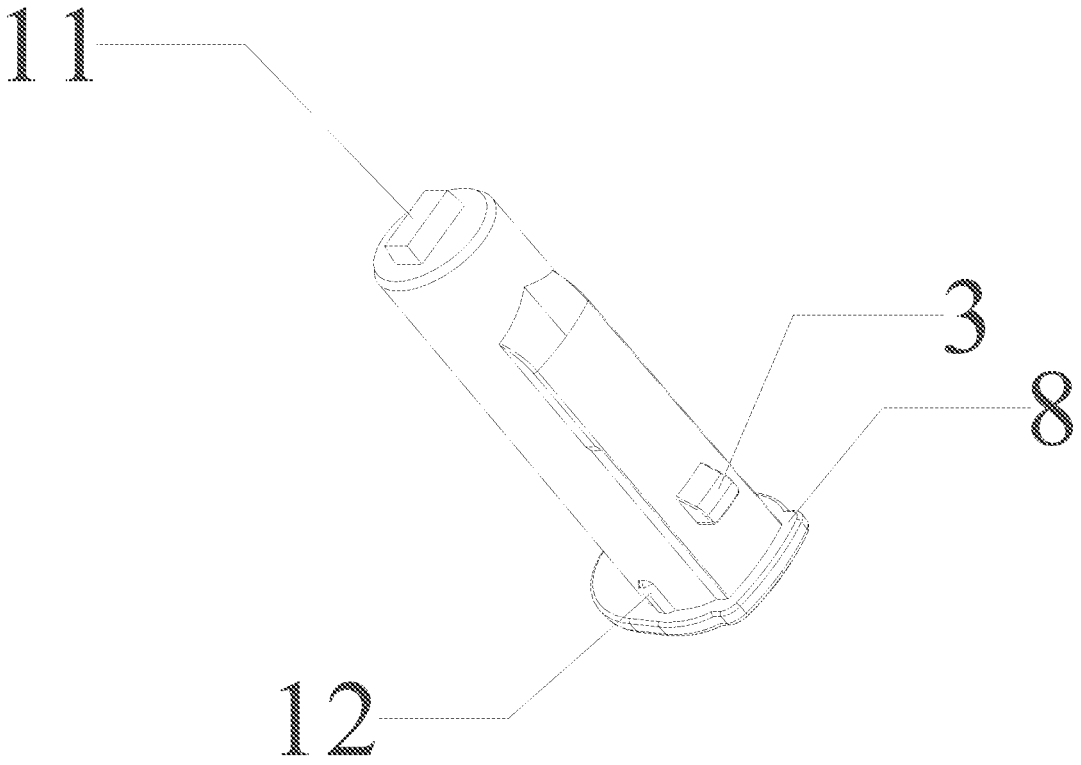
FIG. 4 is a schematic view of the structure of the sleeve of the present, invention.
Figure 5:
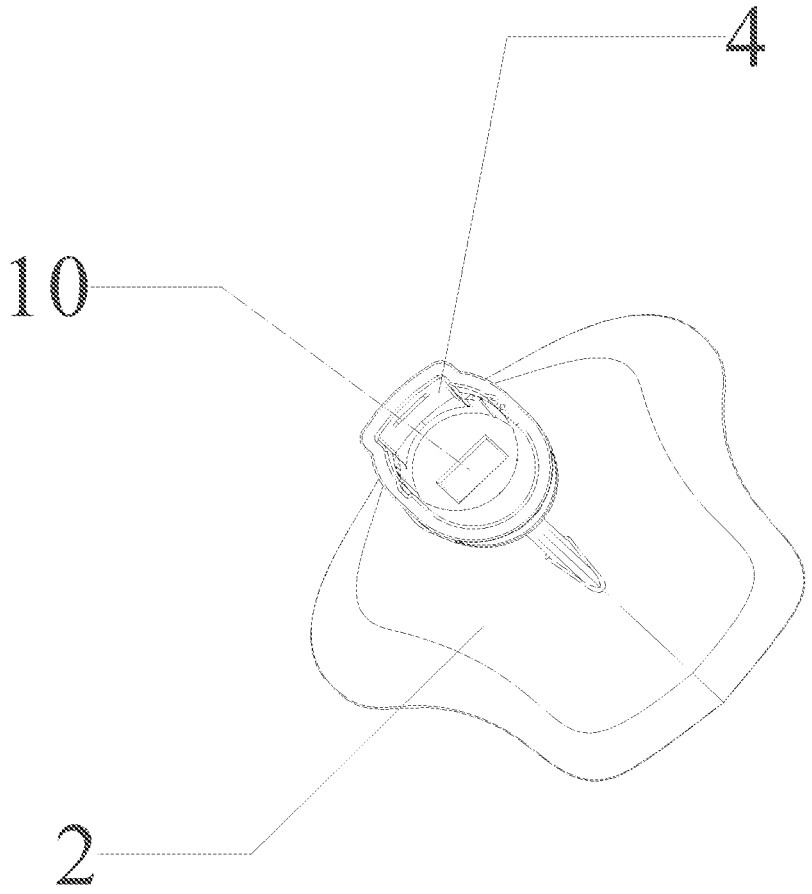
FIG. 5 is a schematic view of the structure of the snow basket of the present invention.

The technical solutions of the embodiments of the present invention model will be clearly and entirely described below with the drawings of the embodiments of the present invention. Obviously, the described embodiments are just a part of the embodiments of the present invention, and are not all of them. All other embodiments that can be obtained by a person skilled in the art based on the embodiments of the present invention without any creative effort are included in the protection scope of the present invention.

It should be noted that, all the directional indications (such as up, down, left, right, front, rear . . . ) in the embodiments of the present invention are merely used for explaining the relative positional relationship and movement conditions and the like between each part under a certain posture (as shown in the drawings), if such a posture changes, then the directional indications are changed correspondingly.

In the present invention, such description involving "first" and "second" and the like are merely for the purpose of description, but cannot be understood as indicating or implying its relative importance or implicitly indicating the quantity of the indicated technical features. Therefore, the feature defined with "first" and "second" can explicitly or implicitly include at least one such feature; secondly, in the description of the present invention, "a plurality of" means at least two, for example, two, three and the like, unless otherwise specifically defined.

In the present invention, unless otherwise definitely prescribed and defined, the terms "connection", "connected", "fixed" and the like should be understood in its broad sense. For example, the "connection" may be a fixed connection, may also be a detachable connection or an integrated connection; may be a mechanical connection, may also be an electrical connection; and the "connected" may be directly connected and can also be indirectly connected through an intermediate medium, and can also be the internal communication inside two elements or an interaction relationship between two elements, unless otherwise definitely defined. The specific meaning of the above-mentioned terms in the present invention may be understood by those of ordinary skill in the art in light of specific circumstances.

In addition, the technical solutions between each embodiment in the present invention can be mutually combined, but should be on the basis that the technical solutions can be realized by those skilled in the art, when the combination of the technical solutions is contradictory or cannot be realized, it should be deemed that the combination of technical solutions does not exist and does not fall within the protection scope claimed by the present invention.

The embodiment of the present application provides with a snow basket quick-release system for a ski pole. The names of the components corresponding to the reference numerals in the figures are as follows: 1. sleeve; 2. snow basket; 3. hook; 4. sleeve mounting groove; 5. engagement groove; 6. press section; 7. L-shaped hollowed-out area; 8. sleeve flange; 9. snow basket flange; 10. anti-rotation groove; 11. polygonal position limiting block; 12. inserting column; 13. inserting hole; 14. tungsten steel pole tip; 15. ski pole.

As shown in FIGS. 1-5, a snow basket quick-release, system for a ski pole includes a sleeve 1 and a snow basket 2, wherein the upper end of the sleeve 1 is provided with a hook 3, the snow basket 2 is provided with a sleeve mounting groove 4, the upper end of the sleeve mounting groove 4 is provided with an engagement groove 5 and a press section 6, the diameter of the press section 6 is slightly larger than the diameter of the sleeve 1, the press section 6 drives the engagement groove 5 to deform elastically, the sleeve 1 is installed on the snow basket 2 by inserting the sleeve, mounting groove 4, and the hook 3 is engaged on the engagement groove 5.

The lower portion of the press section 6 is provided with a L-shaped hollowed-out area 7. The L-shaped hollowed-out area 7 separates the press section 6 from the sleeve mounting groove 4. When the user presses the press section 6 by hand, the elastic deformation of the press section 6 will not affect the sleeve, mounting groove 4, and the magnitude of pressing force only needs to be controlled to drive the press section 6, which can save the user's pressing force and facilitate the use.

The upper portion of the sleeve 1 is provided with a sleeve flange 8, and the lower portion of the L-shaped hollowed-out area 7 is provided with a snow basket flange 9. The sleeve flange 8 and the snow basket flange 9 can protect the press section 6 to avoid its abnormal releasing when impacted by foreign objects, thus causing the sleeve 1 to be abnormally decoupled.

The bottom of the sleeve mounting groove 4 is provided with an anti-rotation groove 10, the bottom of the sleeve 1 is provided with a polygonal position limiting block 11, the shape of the polygonal position limiting block 11 corresponds to the anti-rotation groove 10, and the polygonal position limiting block 11 is inserted in the anti-rotation groove 10 to prevent the relative rotation of the snow basket 2 and the sleeve 1 when the ski pole is used after the sleeve is inserted into the sleeve mounting groove 4, thus causing the problem of abnormal decoupling of the hook 3 from the engagement groove 5, so as to increase the assembly stability of the sleeve 1 and the snow basket 2.

The top of the sleeve 1 is provided with an inserting column 12 arranged along the vertical direction, the press section 6 is provided with an inserting hole 13 corresponding to the inserting column 12, and the inserting column 12 inserted into the inserting hole 13 and fixed when the sleeve 1 is inserted into the snow basket 2. The inserting hole 13 allows the inserting column 12 to move in the vertical direction and restricts the inserting column 12 to move in other directions to prevent the press section 6 from offsetting to the left or right in the direction of pressing force and causing the hook 3 to be decoupled.

The bottom of the snow basket 2 is provided with a tungsten steel pole tip 14. Tungsten steel has the advantages of high hardness and wear resistance, which can prolong the damage time of pole tip and prolong the period of replacing the snow basket 2 for easy use.

The use and working method of the present invention is as follows:

The ski pole 15 is fixed to sleeve 1 by gluing, and the tungsten steel pole tip 14 is mounted on snow basket 2.

Figure 6:
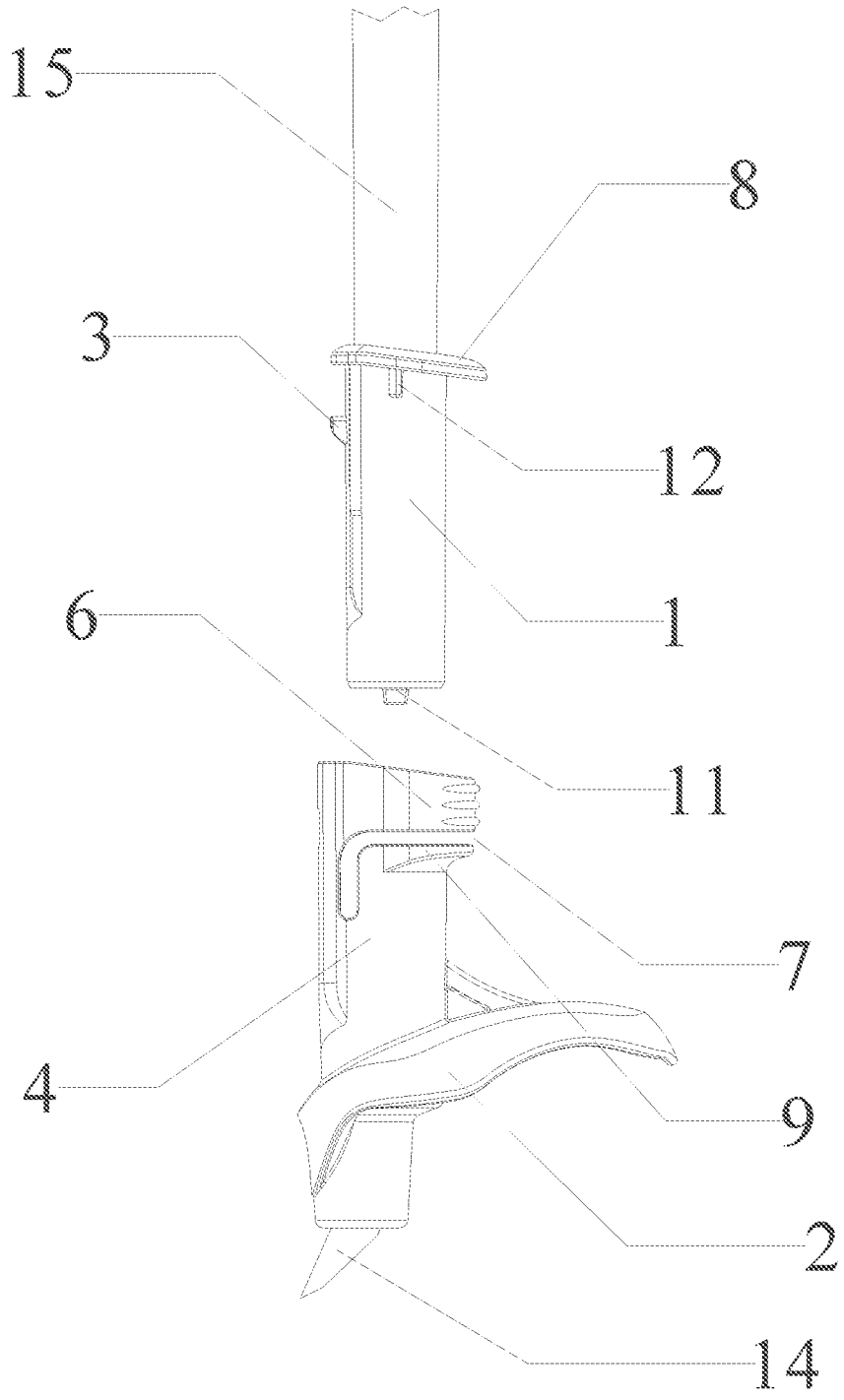
FIG. 6 is a schematic view of the separated structure of the sleeve and the snow basket of the present invention.
Figure 7:
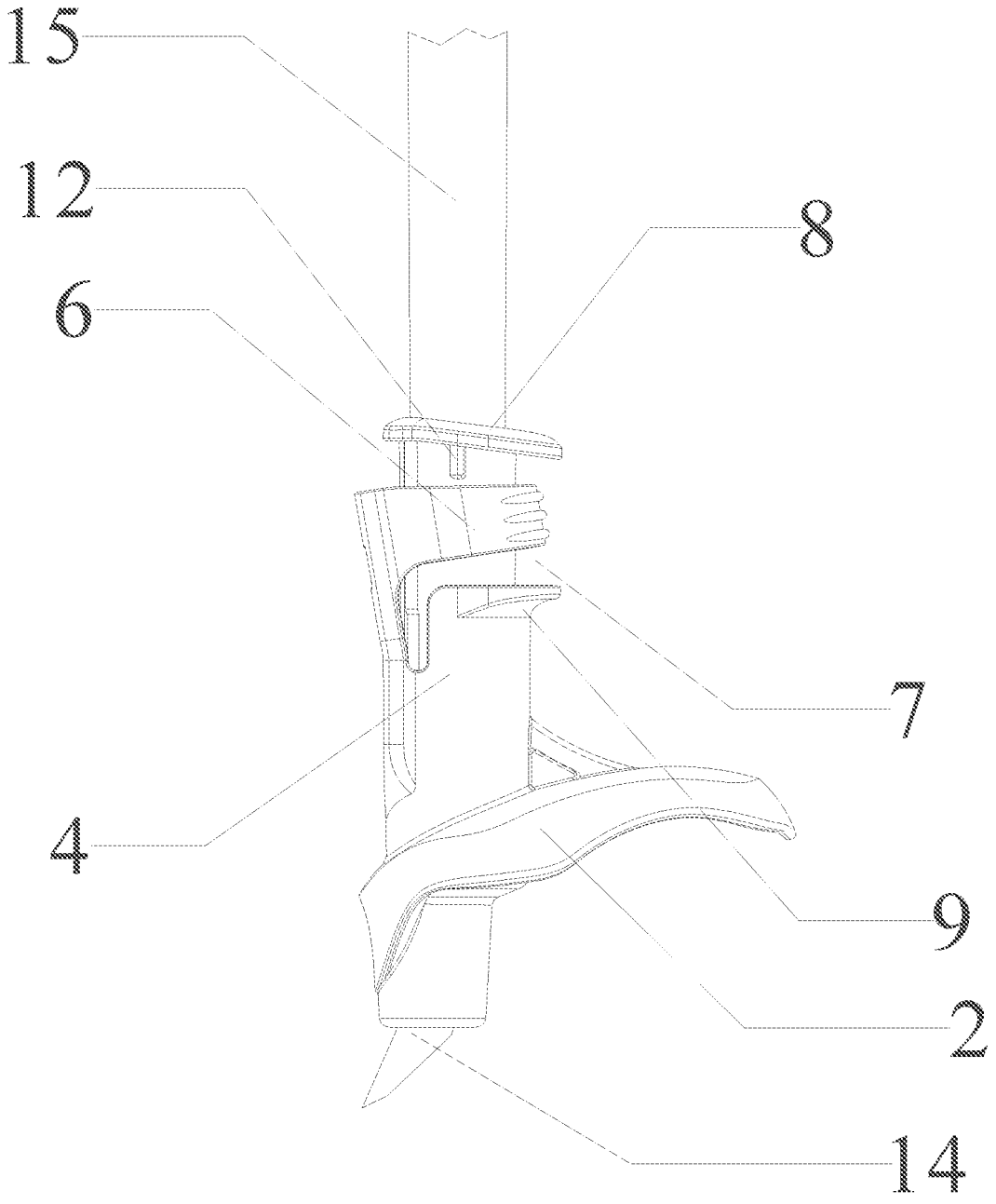
FIG. 7 is a schematic view of the structure of the elastic deformation of the press section of the present invention.
Figure 8:
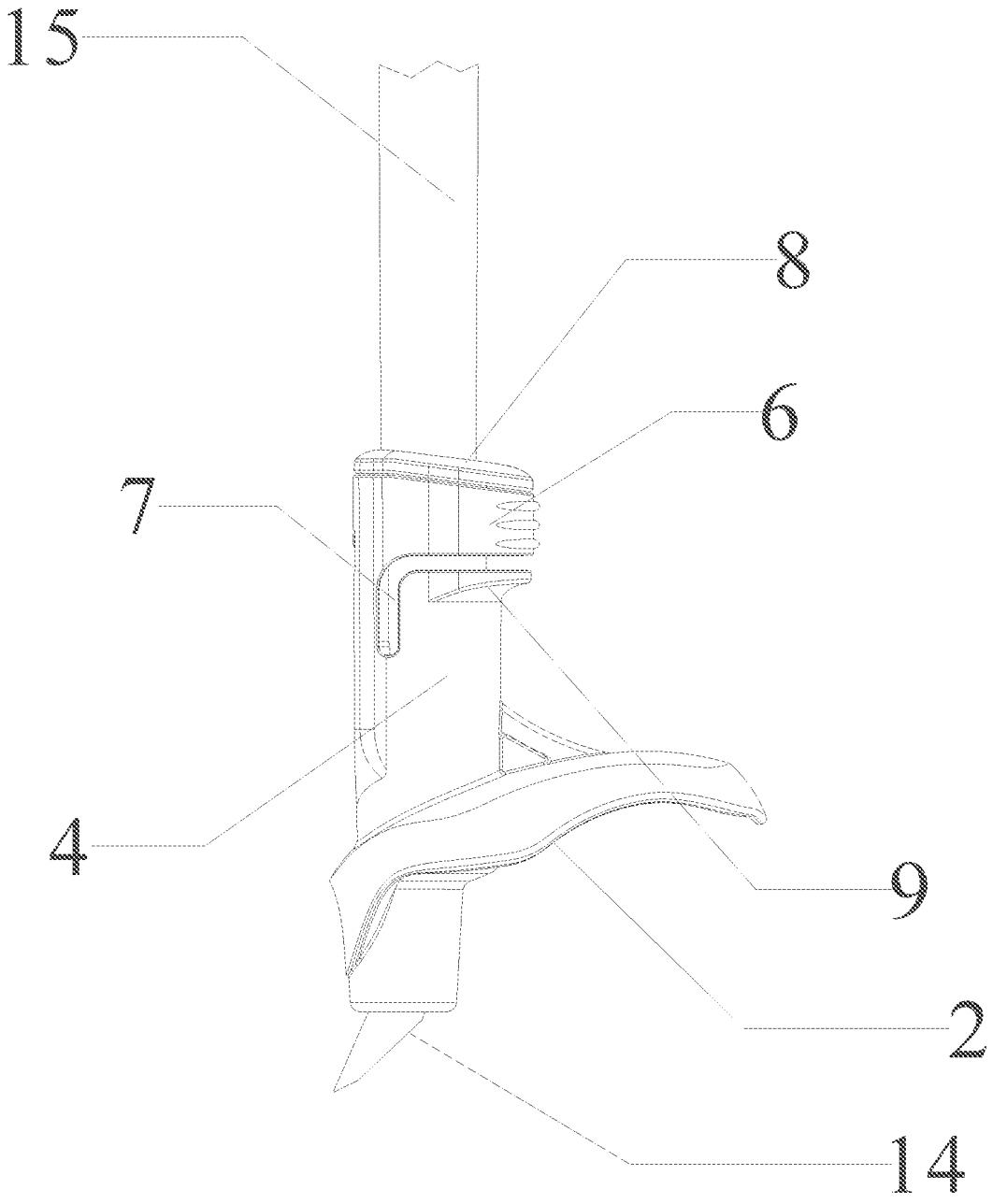
FIG. 8 is a schematic view of the structure of the sleeve and the snow basket of the present invention.

When the sleeve 1 needs to be mounted in the snow basket 2, as shown in FIG. 6, the hook 3 is vertically aligned with the position in which the engagement groove 5 is located. The sleeve 1 is inserted into the sleeve mounting groove 4 on the snow basket 2, the hook 3 is contacted with the press section 6 on the upper end of the sleeve mounting groove 4. As shown in FIG. 7, the hook 3 presses the press section 6, the press section 6 undergoes elastic deformation to accommodate the hook 3 into the sleeve mounting groove 4. As shown in FIG. 8, the sleeve 1 continues to be inserted into the sleeve mounting groove 4, the hook 3 continues to penetrate deeper until it reaches the position of the engagement groove 5, the hook 3 is completely immersed in the engagement groove 5, the hook 3 no longer presses the press section 6, the press section 6 springs back, the snow basket 2 returns to the undeformed state, so that the sleeve 1 and the snow basket 2 are mounted together.

When the sleeve 1 needs to be disassembled from the snow basket 2, as shown in FIG. 7, the press section 6 on the upper end of the sleeve mounting groove 4 is pressed by hands, the press section 6 under pressure undergoes elastic deformation. As shown in FIG. 6, the press section 6 drives the engagement groove 5 elastic outward, the engagement groove 5 is released from the hook 3, the engagement groove 5 no longer restricts the hook 3. At this time the user can directly remove the sleeve 1 from the sleeve mounting groove 4, withdraw the press section 6 by the pressure, the press section 6 springs back, the snow basket 2 returns to the undeformed state, the sleeve 1 is disassembled from the snow basket 2. Repeating the installation of the sleeve 1 allows for quick replacement of the snow basket 2.

Compared with the prior art, the present invention has the following advantageous effects:

The present invention is provided with a sleeve 1 and a snow basket 2, wherein the sleeve 1 is used to connect and fix the ski pole 15, and the pole tip is mounted on the snow basket 2. The ski pole 15 and the pole tip are assembled through the sleeve 1 and the snow basket 2 to be used as ski pole, wherein the upper end of the sleeve 1 is provided with a hook 3, the snow basket 2 is provided with a sleeve mounting groove 4 corresponding to the size of the sleeve 1, the upper end of the sleeve mounting groove 4 is provided with an engagement groove 5 and a press section 6, the diameter of the press section 6 is slightly larger than the diameter of the sleeve 1, thereby allowing a certain amount of press space for the press section 6, and the hook 3 is aligned with the position of the engagement groove 5 when the sleeve 1 is ready to be inserted into the sleeve mounting groove 4. The sleeve 1 begins to be inserted into the sleeve mounting groove 4, the hook 3 presses the press section 6 on the sleeve mounting groove 4, and the press section 6 undergoes elastic deformation to accommodate the hook 3 into the sleeve mounting groove 4. The sleeve 1 continues to be inserted into the sleeve mounting groove 4, the hook 3 continues to penetrate deeper until it reaches the position of the engagement groove 5, the hook 3 is completely immersed in the engagement groove 5, the hook 3 no longer presses the press section 6, the press section 6 springs back, the snow basket 2 returns to the undeformed state, thus completing the installation of the sleeve 1 and the snow basket 2. When replacing the snow bracket 2, the press section 6 on the sleeve mounting groove 4 needs to be pressed, the press section 6 is pressed to drive the engagement groove 5 to, elastically deform, the engagement groove 5 is detached from the hook 3, the user can directly remove the sleeve 1 from the snow bracket 2, thus enabling the disassembly of the snow bracket 2. The installation and disassembly of the snow bracket 2 and the sleeve 1 do not require the use of threads or bolts for locking, and can be operated by hands, the disassembly and installation are simple and quick, and the consumed time and cost are low.

Therefore, the present invention provides with a snow basket quick-release system for a ski pole. The installation and disassembly of snow bracket 2 and sleeve 1 do not require professional tools to operate, a user can complete the disassembly and installation of snow bracket 2 with their bare hands, the installation is convenient and quick and saves time and costs.

The above described embodiments are only the exemplary embodiments of the present invention. It should be noted that, the present invention is not limited to the above exemplary embodiments, and the protection scope of the present invention is defined by the claims. For a person skilled in the art, on the premise of not departing away from the spirit and scope of the present invention, several improvements and modifications may also be made, and such improvements and modifications are also deemed to be within the protection scope of the present invention.

The invention claimed is:

1. A snow basket quick-release system for a ski pole, characterized in that it includes a sleeve and a snow basket, wherein the upper end of the sleeve is provided with a hook, the snow basket is provided with a sleeve mounting groove, the upper end of the sleeve mounting groove is provided with an engagement groove and a press section, the diameter of the press section is slightly larger than the diameter of the sleeve, the press section drives the engagement groove to deform elastically, the sleeve is installed on the snow basket by inserting the sleeve mounting groove, and the hook is engaged on the engagement groove, the lower portion of the press section is provided with a L-shaped hollowed-out area, the upper portion of the sleeve is provided with a sleeve flange, and the lower portion of the L-shaped hollowed-out area is provided with a snow basket flange.

2. The snow basket quick-release system for a ski pole according to claim 1, characterized in that the bottom of the sleeve mounting groove is provided with an anti-rotation groove, the bottom of the sleeve is provided with a polygonal position limiting block, the shape of the polygonal position limiting block corresponds to the anti-rotation groove, and the polygonal position limiting block is inserted in the anti-rotation groove.

3. The snow basket quick-release system for a ski pole according to claim 1, characterized in that the top of the sleeve is provided with an inserting column arranged along the vertical direction, the press section is provided with an inserting hole corresponding to the inserting column, and the inserting column is inserted into the inserting hole and fixed when the sleeve is inserted into the snow basket.

4. The snow basket quick-release system for a ski pole according to claim 1, characterized in that the bottom of the snow basket is provided with a tungsten steel pole tip.

* * * * *